United States Patent [19]

Baker

[11] Patent Number: 4,531,179

[45] Date of Patent: Jul. 23, 1985

[54] LIGHT FIXTURE

[75] Inventor: Ronald D. Baker, Conway, Ark.

[73] Assignee: American Industries, Inc., Conway, Ark.

[21] Appl. No.: 590,774

[22] Filed: Mar. 19, 1984

[51] Int. Cl.[3] ..... F21P 5/00

[52] U.S. Cl. ..... 362/371; 362/294; 362/362; 362/363; 362/368; 362/370; 362/374; 362/375; 362/376; 362/396; 362/453; 362/454; 362/369

[58] Field of Search ..... 362/294, 362, 363, 368, 362/369, 370, 371, 374, 375, 376, 396, 453, 454

[56] References Cited

U.S. PATENT DOCUMENTS 3,396,269 8/1968 Sorenson ..... 362/455

*Primary Examiner*—Stephen J. Lechert, Jr.

*Attorney, Agent, or Firm*—Senniger, Powers, Leavitt and Roedel

[57] ABSTRACT

A light fixture for mounting at the bottom of a switch housing of a ceiling fan which has an opening therein. The fixture comprises a top member and a contractible and expansible locking member secured in the top member of the fixture and extending upwardly therefrom. The locking member is adapted to contract for insertion of the member through the opening in the bottom of the housing and expand for locking the member to the housing. Also disclosed is means for retarding the transmission of noise and vibrations from the switch housing to the light fixture thereby preventing damage to the components of the light fixture and extending the life of a light bulb in the fixture.

6 Claims, 3 Drawing Figures

LIGHT FIXTURE

BACKGROUND OF THE INVENTION

This invention relates generally to light fixtures and, more particularly, to a light fixture for mounting at the bottom of a switch housing of a ceiling fan.

One method typically used for mounting a light fixture at the bottom of a switch housing of a ceiling fan is to pass a threaded nipple of the fixture through an opening in the bottom of the switch housing and then secure the fixture in position with a nut. However, this is time consuming in that the switch housing must be removed from the ceiling fan and then reattached after the nut has been threaded on the nipple. A second method is to have a threaded opening in the bottom of the switch housing and to thread the nipple of the fixture into the opening. Although this is a relatively easy way of connecting the two objects, in the case of a chandelier or other multi-bulb light the necessity of securing the fixture tightly against the housing may not easily enable the user to place the lights in a desired position. Another problem encountered with light fixtures for ceiling fans is that vibrations caused by the rotation of the fan are usually transmitted to the fixture itself and these vibrations decrease the life of the light bulb or bulbs of the fixture.

SUMMARY OF THE INVENTION

Among the several objects of this invention may be noted the provision of a light fixture which is easy to connect to the bottom of a switch housing of a ceiling fan; the provision of a light fixture which allows the light unit of the fixture to be positioned as desired; the provision of a light fixture which reduces the transmission of vibration from the ceiling fan into the light unit; and the provision of such a light fixture which is simple and economical in construction.

In general, a light fixture of this invention is one that mounts at the bottom of a switch housing of a ceiling fan. The switch housing has an opening therein. The fixture comprises a top member and a contractible and expansible locking member secured in the top member of the fixture which extends upwardly from the top member. The locking member is adapted to contract for insertion of the member through the opening in the bottom of the housing and expand for locking the fixture to the housing.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF PREFERRED EMBODIMENT

Figure 1:
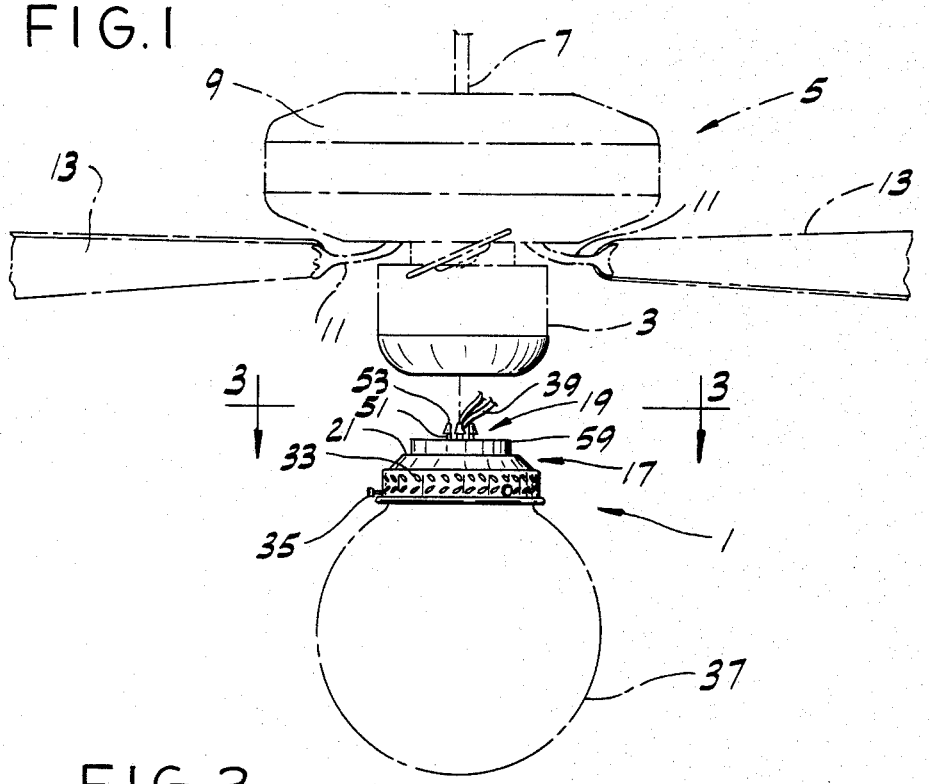
FIG. 1 is a front elevation of a light fixture of this invention showing a fan, switch housing, and diffuser in phantom.
Figure 3:
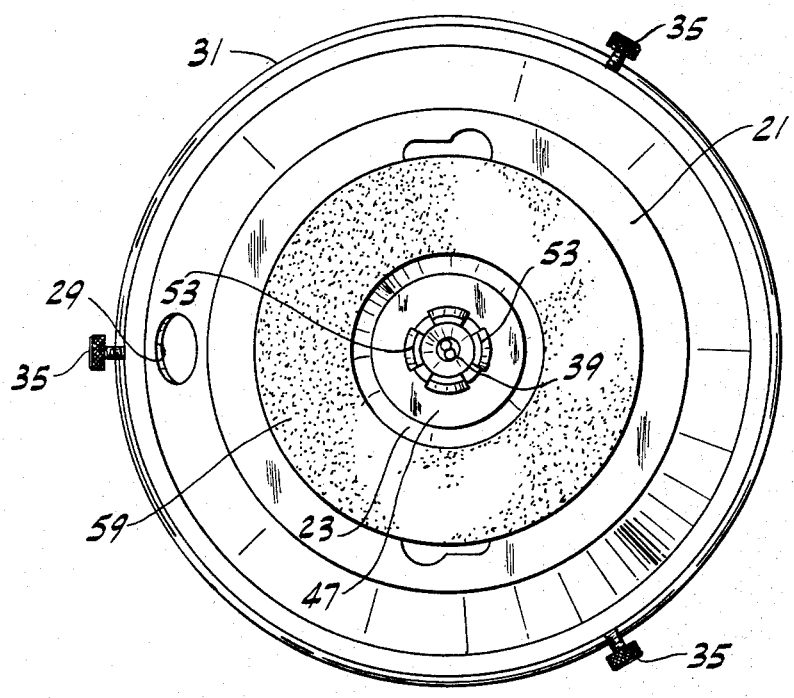
FIG. 3 is a horizontal section on line 3—3 of FIG. 1.

Referring to the drawings, there is generally indicated at 1 a light fixture for mounting at the bottom of a switch housing 3 of a ceiling fan 5. The fan 5 is suspended by suitable means 7 from a ceiling (not shown) and comprises an electric motor housing 9, fan blade holder arms 11 which are secured to a flywheel (not shown) in the motor housing 9, and fan blades 13 which are suitably secured to the arms 11. The switch housing 3, as shown in FIG. 2, has an opening 15 at the bottom thereof in an upwardly extending boss 16.

The fixture 1 comprises a top member 17 and a contractible and expansible locking member 19 secured therein. The top member 17 is generally circular in horizontal cross-section and has a top face 21 with a depression 23 in the center thereof. The depression 23 has a generally flat bottom surface 25 and an opening 27 in the center thereof. The top face 21 is sloped downwardly and outwardly generally at its periphery and this sloped portion has an opening 29 therein. Member 17 further has a downwardly extending annular flange or skirt 31 at the periphery of the top 21 with a plurality of ventilation openings 33 therein. The flange or skirt 31 has a plurality of holes therein adjacent its lower end of the flange for the insertion of screws 35 for retaining a diffuser 37 in position.

Figure 2:
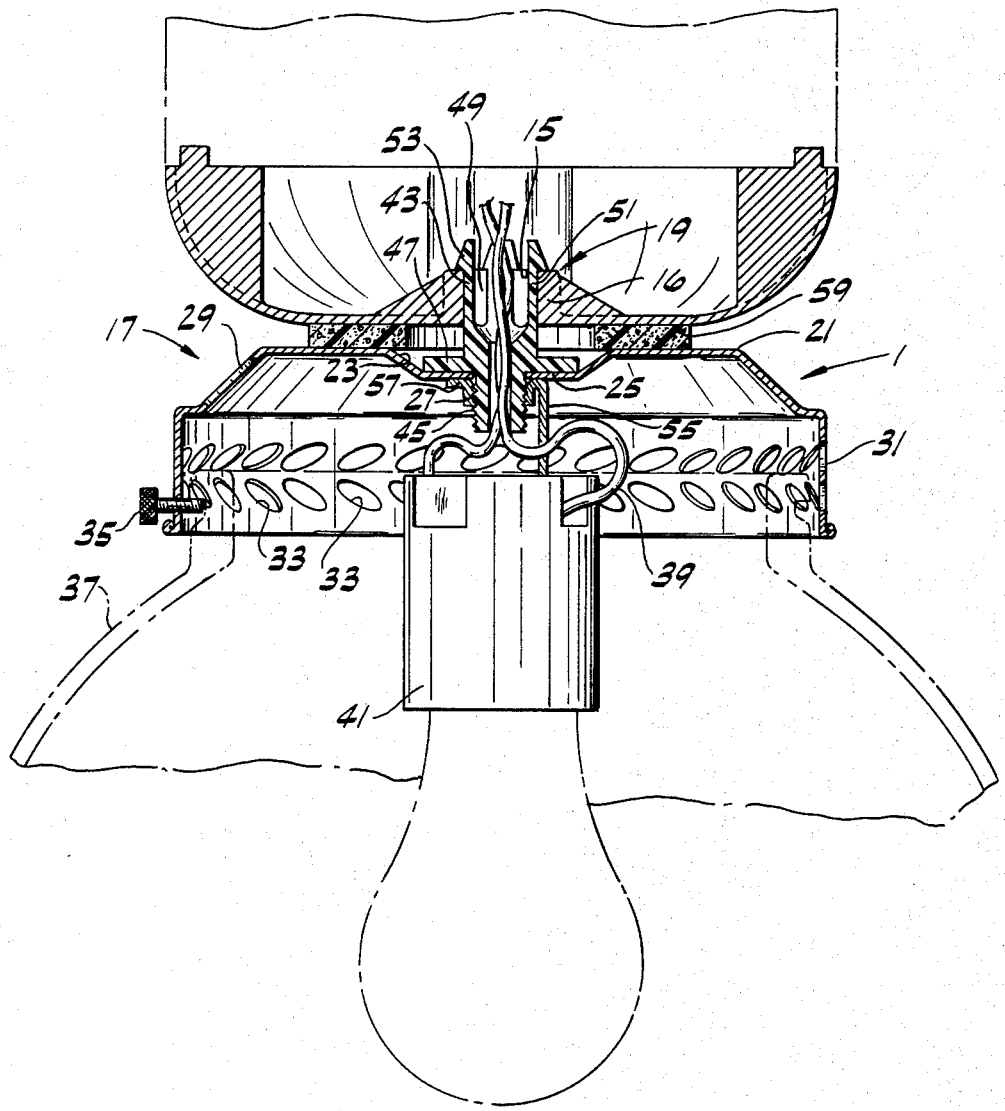
FIG. 2 is an enlarged vertical section.

As particularly shown in FIG. 2, the locking member 19 extends upwardly from the top member 17 and is generally tubular in horizontal cross-section for the passage of electrical wiring 39 from the light fixture socket 41 to an electrical source (not shown). Locking member 19 is a one-piece molded plastic part (molded of nylon, for example) having an upper portion 43 and a lower portion 45 with an external flange or collar 47 therebetween. The upper portion of the locking member has slots 49 which extend down from its upper (free) end dividing the upper member into a plurality of upwardly extending resilient fingers or spring detent means 51. The fingers have outwardly extending lugs 53 at their upper ends. The lugs are conical for facilitating the wedging of the locking member in the opening 15 of the housing as will be described later. It will be understood that the locking member 19 contracts for insertion of the member through the opening 15 in the bottom of the housing and expands for locking the fixture to the housing. The maximum outside diameter of the upper portion of the member 19 is greater than the diameter of the opening in the housing and the member is contractible to a diameter which is sufficiently small to permit passage of the lugs through the opening. The lower portion 45 of the member is in the form of a threaded stem extending downwardly from the top portion 43. The stem 45 is inserted into the opening of the top member so that the collar 47 rests generally flush against the outside face of the flat surface of the depression 23.

A Z-shaped bracket 55, constituting securing means, secures the locking member 19 in the top member of the fixture. The bracket has an upper arm 57 and a lower arm (not shown). The upper arm has a threaded opening therein and is threaded onto the stem 45 of the locking member. The lower arm is suitably attached to the light socket 41 whereby when the bracket is threaded onto stem 45 the socket is held in a desired position. It will be understood that where a chandelier type unit is to be mounted, a nut may be utilized to hold the locking member in position.

Another feature of this invention is the use of a ring 59 of soft, resilient vibration-deadening material, e.g., polyvinyl chloride foam or the like, constituting means for retarding the transmission of vibrations from the switch housing to the light fixture. The ring 59 is secured (e.g., glued) to the top surface of the top member. As shown in FIG. 2, the ring is disposed between the top member and the bottom of the switch housing and acts like a buffer to absorb any vibrations, thereby preventing damage to the components of the light fixture and extending the life of the bulb.

In mounting the light fixture to the switch housing, the stem 45 is inserted into the opening 27 of the member 17 and is threaded into the opening of the upper arm 57 until the collar 47 is secured flush against the upper face of the flat surface of the depression 23. With the wires 39 extending through the tubular locking member and the fan housing 3 to connections in the switch housing, the locking member is wedged into the opening 15 in the bottom of housing 3 until a "click" is heard thereby signifying that the lugs 53 of locking member 19 have expanded over the upper end of the boss 16 thereby locking the fixture in place. Since ring 59 is prepositioned on the top face of member 17, it lies between the bottom face of the housing 3 and the top face of member 17. In the case of a single bulb light, as shown in the drawings, a bulb is screwed into the socket and the diffuser is mounted by use of screws 35. Where a chandelier type light fixture is mounted to the housing, the chandelier may be easily rotated until it is in a desired position.

It will be understood from the above description that the use of the contractible and expansible locking member 19 provides an easy and effective way of attaching the light fixture to a fan housing.

It will be further understood that the ring 59 provides a buffer to absorb any noise or vibrations and thus extends the life of the bulb (or bulbs).

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A light fixture for mounting at the bottom of a switch housing of a ceiling fan, the bottom of the switch housing having a circular opening therein, the fixture comprising a top member and a contractible and expansible locking member secured in said top member of the fixture and extending upwardly therefrom, said locking member being adapted to contract for insertion of the member through the opening in the bottom of the housing and expand for locking the fixture to the housing, said locking member being generally tubular for the passage of wiring from the light fixture into the switch housing and having slots extending down from its upper end dividing it into a plurality of resilient fingers, said fingers having outwardly extending lugs at their upper ends, the maximum outside diameter of the member at its upper end being greater than the diameter of the opening in the housing, said locking member being contractible to a diameter which is sufficiently small to permit passage of the lugs through said opening and expansible to a diameter whereby the lugs extend to a greater diameter than the opening and engage the switch housing for locking the fixture in place.

2. A light fixture as set forth in claim 1 wherein the lugs are conical for facilitating the wedging of the locking member in the opening of the housing.

3. A light fixture as set forth in claim 2 wherein the locking member has a collar at the lower end thereof and a threaded stem extending downwardly therefrom, said stem being adapted to be inserted into an opening in said top member, and means threaded onto the stem for securing the locking member in said top member of the fixture.

4. A light fixture as set forth in claim 3 wherein said securing means comprises a bracket having an upper arm, the upper arm having a threaded opening therein and adapted to be threaded onto the threaded stem, the bracket being attached to a light socket whereby when the bracket is threaded onto the threaded stem the socket is held in a desired position.

5. A light fixture as set forth in claim 1 wherein the top member has means for retarding the transmission of vibrations from the switch housing to the light fixture thereby preventing damage to the components of the light fixture and extending the life of a light bulb in the socket.

6. A light fixture as set forth in claim 5 wherein said retarding means comprises a ring of vibration-deadening material which is disposed between the top member and the housing.

* * * * *